US006123233A

United States Patent [19]

Nussbaumer

[11] Patent Number: 6,123,233

[45] Date of Patent: Sep. 26, 2000

[54] DISCHARGE ARRANGEMENT FOR DISCHARGING BULK MATERIAL FROM A RECEPTACLE

[75] Inventor: Arthur Nussbaumer, Düdingen, Switzerland

[73] Assignee: AT Anlagetechnik AG, Dudingen, Switzerland

[21] Appl. No.: 09/241,406

[22] Filed: Feb. 2, 1999

[30] Foreign Application Priority Data

Feb. 2, 1998 [EP] European Pat. Off. ..... 98101720

[51] Int. Cl.[7] ..... B67D 5/06

[52] U.S. Cl. ..... 222/200; 222/501; 222/504; 222/509; 222/542

[58] Field of Search ..... 222/196, 200, 222/501, 504, 509, 542

[56] References Cited

U.S. PATENT DOCUMENTS

| | | | |
|---|---|---|---|
| 2,166,484 | 7/1939 | Carlson | 222/504 |
| 2,953,166 | 9/1960 | Carlson, Jr. . | |
| 3,733,012 | 5/1973 | Grun | 222/504 X |
| 4,470,524 | 9/1984 | Semenenko | 222/504 X |
| 4,691,843 | 9/1987 | Dunan | 222/509 |
| 5,582,332 | 12/1996 | Kiefer et al. | 222/504 |
| 5,775,544 | 7/1998 | Semenenko | 222/504 X |
| 5,893,567 | 4/1999 | Bitterli | 277/646 |

FOREIGN PATENT DOCUMENTS

| | | |
|---|---|---|
| 0 045 163 | 2/1982 | European Pat. Off. . |
| 0 049 992A1 | 4/1982 | European Pat. Off. . |
| 0 049 992B1 | 6/1985 | European Pat. Off. . |
| 0 346 523 | 11/1988 | European Pat. Off. . |
| 27 51 430 | 5/1979 | Germany . |
| 41 12 885 | 10/1992 | Germany . |
| 296 09 542 U | 11/1996 | Germany . |
| 295 21 542 U | 8/1997 | Germany . |
| 90/08724 | 8/1990 | WIPO . |

*Primary Examiner*—Kenneth Bomberg

*Attorney, Agent, or Firm*—Burns, Doane, Swecker & Mathis LLP

[57] ABSTRACT

A discharge arrangement for discharging bulk material through a discharge opening of a receptacle, such as a bin, includes a closure member that is movable from an open position into a closed position relative to the discharge opening. To this end, an actuator assembly is connected to the closure member for moving it into one of its positions. The actuator assembly includes a cylinder having a inner surface diameter which defines a cavity in which a piston is movable in an axial direction. The piston has an outer surface diameter smaller than the inner diameter of the cylinder so as to leave a gap in-between. A rolling membrane between the opposing surfaces of the piston and the cylinder seals this gap and provides rolling friction when the piston moves within the cylinder. A linear guide unit is provided between the cylinder and piston and guides the movement of the latter.

33 Claims, 2 Drawing Sheets

DISCHARGE ARRANGEMENT FOR DISCHARGING BULK MATERIAL FROM A RECEPTACLE

FIELD OF THE INVENTION

This invention relates to a discharge arrangement for discharging bulk material from a receptacle, and more specifically to a discharge arrangement which comprises a closure member for closing a discharge opening of the receptacle, the closure member being movable from an open position into a closed position by an actuator arrangement. Such an actuator arrangement includes a cylinder defining a cavity, and a piston movable and reciprocating within said cylinder along a longitudinal axis of the same to displace the closure member between its positions.

BACKGROUND OF THE INVENTION

U.S. Pat. No. 4,691,843 and WO 90/08724 disclose discharge arrangements comprising a piston-cylinder assembly. However, such a piston-cylinder assembly tends to jam when the bulk material presses asymmetrically onto the closure member. In fact, the piston is guided in the known arrangements by the outer circumference of the piston within the cylinder, on the one hand, and by a bushing in one front end of the cylinder through which passes the piston rod, on the other hand. Since the distance between these two guides is smallest as soon as the piston reaches the position which corresponds to the open position of the closure member, the stability of the guidance is poor just when the closure member opens and is vibrated either by the outflowing bulk material or a vibrator for promoting flow of material or both. Therefore, the forces acting transversely to the axis of the piston and cylinder are strongest in a position where the guidance is weak.

A further disadvantage of the known arrangements is that the guiding zones exert high frictional forces obstructing the piston's movement. This is particularly disadvantageous for various purposes envisaged. For example, receptacles of the above-mentioned kind are often bins used to fill so-called Intermediate Bulk Containers or IBC's used to transfer hazardous or sensitive bulk material. When the IBC has been filled up, the discharge opening of the bin should be closed as quickly as possible to avoid an overflow. Therefore, it was necessary, heretofore, to use piston-cylinder arrangements which are actuable from both sides to effect opening and closing movement. This involves higher expenditure for establishing a corresponding two-sided control.

U.S. Pat. No. 4,470,524 discloses the use of an inflatable bellow to avoid the risk of jamming, thus dispensing with a rigid guidance. This entails more flexibility with respect to the vibrations mentioned above. By supplying a fluid under pressure, the bellow is expanded substantially in a longitudinal direction, thus opening the closure member. When an IBC is filled up, pressurization is interrupted so that the bellow is compressed by the weight of the parts above it, and especially by the weight of the bulk material. Since a bellow is, however, also expandable in a direction transverse to the longitudinal direction, a relatively large amount of pressurized air is required and, consequently, a large amount of time is required to press it out again. Therefore, the closure time attained by such a construction, from the moment where closure is commanded up to complete shut off of the discharge opening, is too long as to ensure exact metering of the bulk material. Slow closure is also caused by a relatively high inherent deformation resistance of the bellows.

Although a linear guiding unit has been assigned to the bellow, its high flexibility leads to a tendency to digress from a straight path of movement whenever the bulk material presses asymmetrically onto the closure member. If the bulk material contains agglomerated particles, these larger particles can be clamped in the annular space between the closure member and the discharge opening in an asymmetric position, thus preventing complete closure of the opening. Thus, although flexibility is advantageous under vibrations in an open position, it is most disadvantageous for closing the discharge opening completely.

SUMMARY OF THE INVENTION

Therefore, it is an object of the present invention to provide a discharge arrangement for discharging bulk material in an exactly metered way which is simple in construction, does not jam and ensures quick closure.

It is a further object of the invention to permit vibrations of the closure member in an open position, but to ensure, nevertheless, a precise closure of the discharge opening in a closed position of the closure member.

These objects are attained, generally speaking, by using a cylinder which has a first predetermined inner surface diameter defining its cavity, and a piston which has a second predetermined outer surface diameter smaller than the first diameter of the cylinder so as to leave a gap between the inner surface of the cylinder and the outer surface of the piston. To avoid having this gap prevent functioning of a piston-cylinder arrangement, a rolling membrane, or rolling diaphragm, is provided between the inner and outer surfaces of the cylinder and the piston, respectively, to seal the gap, and concurrently provide rolling friction when said piston moves within said cylinder. Since rolling friction is always smaller than sliding friction (as with piston seals of the ordinary type), this enhances quick closure of the discharge opening. In such a construction, the cylinder can be partially closed at the end facing the closure member or can be open.

By providing a linear guide between the cylinder and piston for guiding the movement of the piston, which linear guide is attached exclusively to the piston at the side averted from the closure member, the linear guide can be configured to permit some vibrations when the piston is in its extreme position corresponding to the open position of the closure member, while it is relatively more rigid as soon as the closure member approaches its closed position.

However, the linear guide need not necessarily be at the side averted from the closure member, but can be formed by surfaces of the piston and the cylinder. In such a case, the above objects, according to another aspect of the present invention, are attained by having the above-mentioned rolling membrane provided in conjunction with a cylinder whose open front end faces the closure member. This has two advantages: on the one hand, the open space allows slight deflections of the piston, if the construction is more flexible, such deflections being favored by the rolling membrane. On the other hand, friction cannot occur where there are no parts which engage frictionally; which means that such a construction reduces friction that could impede quick closure.

A rolling membrane can be formed thin and mobile such that the inner resistance against deformation during the movement of the piston is very small. Correspondingly, an extremely short closure time can be ensured.

This means that, as soon as pressure in the cylinder ceases, the piston displaces practically unimpeded into the closed position of the closure member. Tests have shown that, using a bellow according to the prior art, it needs 2 seconds from a given command to close the discharge opening, whereas with use of a rolling membrane in a comparable configuration, the closure time is about a tenth or only 0.2 seconds.

Of course, when using a rolling membrane, it has a sealing function. Guiding the piston within the region of the rolling membrane, although possible, should be done in a manner which takes into account excessive wear of the membrane that could possibly lead to slowing down the closure movement. In order to separate the sealing and the guiding functions, the piston-cylinder assembly can be connected to the linear guidance which is, preferably, at the side averted from the closure member.

The rolling membrane can form a toroidal member freely interposed between the piston and the cylinder. Alternatively, the rolling membrane can be connected at least to one of said cylinder and piston so as to secure its relative position. Particularly low rolling friction and a stable position of the membrane is ensured, if the rolling membrane is connected to both said cylinder and said piston, suitably in such a way that the rolling membrane forms an annular reversing portion between its ends so that the membrane is doubled. In this case, the reversing portion will roll over part of the membrane length when said piston moves within its cylinder.

As to the linear guidance, it can comprise a sleeve for guiding a guiding rod of any cross-section and shape desired. Such a linear guiding device may not leave any play, or very little play which is insufficient to clamp or affect the rolling membrane between the outer surface of the piston and the inner surface of the cylinder. The material used to form the rod can be elastic to absorb any vibration transferred to it, particularly in conjunction with the gap between the piston and the cylinder which is sealed by the rolling membrane even under the cylinder's fluid pressure.

The sleeve can comprise a narrow portion for guiding the rod and a wider portion, so that the wider portion does not impart any friction to the rod. These portions can be made from a single sleeve body widened in one portion over its length or shrunk in the region of the narrow portion. It is, however, preferable if the two portions are formed by two separate parts fastened together.

By the passive, extremely fast behavior of an arrangement free from any trouble, precise metering is ensured. At the same time, the actuation device is simple in construction and reliable, requiring little maintenance work. Since closure can be effected in a passive way, i.e. without using a double acting cylinder, but merely the weight of the devices above the piston plus the weight of the bulk material, for closing the discharge opening, the control circuit and the fluid supply can be very simple and cost effective.

The piston-cylinder assembly can be decoupled from any vibration that could act upon the discharge arrangement. This can be done, according to exemplary embodiments of the invention, by providing the interconnection between the piston-cylinder assembly and the closure member with a first and a second plate displaceably interconnected relative to each other so that the closure member can vibrate within, transferring any motion or force to the plate connected to the piston-cylinder assembly which, in this case, can be made relatively rigid.

The linear guiding device can easily be adjusted to different strokes for a particular application. Furthermore, the maximum level of the piston's stroke can be adjusted by using a height adjusting device which is connected to the piston for adjusting the level of the closure means relative to said discharge opening. If the effective free discharge opening between the closure member and the edge of the discharge opening is adjustable via the stroke level, it can be adjusted in accordance with the discharge resistance of a particular bulk material so that precise metering is possible for different and/or difficult bulk materials.

In an alternate embodiment of the linear guide means, an elongated guide member is provided along the longitudinal axis of the arrangement which is connected to the cylinder. The top end of the guide member has a smaller width than said bottom end, either in steps or in a continuously tapered manner. The piston has a hollow structure complementary in dimension to the guide member. In this way, the hollow structure of the piston substantially engages said guide member when said closure member is in its closure position, thus assuming a rigid position, whereas an annular gap is formed between the piston structure and the guide member when said closure means are in an open position. This allows greater mobility and/or less transfer of forces onto the cylinder under vibration.

This adjustment can be effected automatically. For example, if the discharge arrangement can comprise a prime mover for positioning an adjustable stop along the rod, particularly of the linear guidance.

BRIEF DESCRIPTION OF THE DRAWINGS

Further details and advantages of the invention will become apparent from the following description of embodiments schematically shown in the drawings in which.

DETAILED DESCRIPTION OF THE PREFERRED EMBODIMENTS

Figure 1:
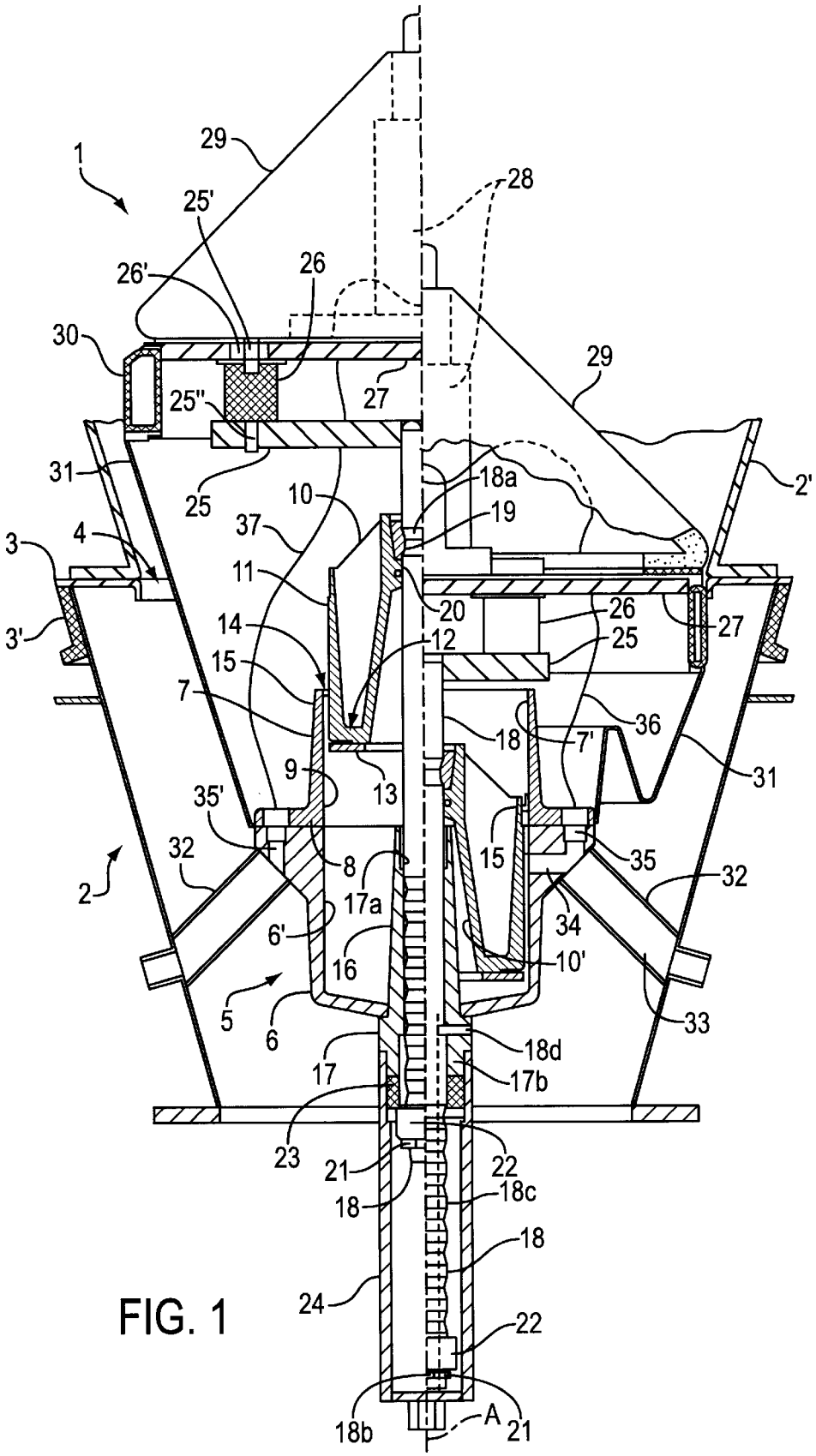
FIG. 1 shows a vertical cross-section through an exemplary discharge arrangement shown in a maximally opened position at left, and in closed position at the right of its longitudinal axis according to a first embodiment.

FIG. 1 shows an exemplary discharge arrangement 1 of a receptacle or bin formed by walls 2' onto which a lower housing, or discharge, part 2 can be connected, e.g. by fastening via a connection flange 3. Alternatively, an IBC, as defined before, can be docked onto the lower side of the bin's housing walls 2' so as to be in sealing engagement with an annular sealing member 3'. According to a further variation, an IBC can be attached to the lower end of the lower discharge part 2 of the bin 2'. A sealed arrangement used in connection with a bin is disclosed, for example, in the co-pending U.S. patent application Ser. No. 08/853,646, the contents of which are incorporated herein by reference in their entirety.

The bin has a discharge opening 4 to be closed by a conical closure member 29 as indicated at the right side of FIG. 1. The closure member 29 can take any suitable shape, but is preferably conical so as to guide bulk material contained in the bin 2' to the side where an annular opening exists when the closure member 29 is lifted, as is indicated at the left side of FIG. 1. Thus, the discharge opening 4 forms the entrance opening of the lower housing part 2. In order to lift or move the closure member from its closed position shown at right of FIG. 1 to its open position shown at left of FIG. 1, a piston-cylinder assembly 5 is provided.

The piston-cylinder assembly 5 includes a lower, cup-shaped cylinder portion 6 to which an upper, sleeve-shaped cylinder portion 7 is attached via fastening flanges 8. Preferably one end of a rolling membrane 9 is also fastened between the fastening flanges 8 of the two cylinder portions 6, 7. Within the cavity defined by these cylinder portions 6, 7, a preferably cup-shaped, piston member 10 is provided, having a cylindrical outer surface 11. The piston member 10 conveniently has a fastening arrangement 12 for the other end of the rolling membrane 9. In the embodiment shown, this fastening arrangement 12 is in the region of the lower front side of the cup-shaped piston member 10 and includes a clamping element 13 attached to the piston member 10 by any suitable means, such as by screws indicated by dash-dotted lines.

As shown in heavy lines, the rolling membrane 9 is accommodated within a gap 14 between the outer surface 11 of the piston member 10 and the inner surfaces 6' and 7' of the cylinder portions 6 and 7 which is wider in diameter than the piston member 10 so as to form the gap 14. Although this gap 14 would allow formation of the rolling membrane 9 as a toroidal resilient body having its ends closed, it is preferred to have a membrane 9 which is attached to at least one part of the piston-cylinder assembly 5, and most preferably to both as is shown in FIG. 1. The rolling membrane 9 extends from the fastening region or arrangement 12 at the lower front end of the piston member 10 somewhat upwards up to a doubled annular portion 15 of the membrane 9 where it turns downwards to the fastening region between the fastening flanges 8. The gap 14 is broad enough that the membrane 9 can roll over the doubled annular portion 15 in an almost friction-free manner (e.g., only rolling friction is effective) when the piston member 10 moves up and down while, at the same time, the doubled annular portion 15 rolls up and down as can be seen when comparing the right side and the left side of FIG. 1. However, a gap 14 too large is not preferred. In such a case, the pressure of fluid supplied to the cavity of the cylinder portions 6, 7 through a supply conduit 33 and the gap 14 down within the cup-shaped cylinder portion 6 could result in forces deforming the doubled portion 15 and the rolling membrane 9 when it is relatively thin. A gap 14 adapted to the thickness of the rolling membrane 9 ensures a well-defined rolling behavior of the same. It is further preferred not to use the membrane 9 as a means for absorbing vibrations from above either by the bulk material alone when it flows down through the opening 4 or by a vibrator device 28 to be described later (although such use would be possible within the scope of the present invention), but to decouple such vibrations. By sealingly connecting the membrane 9 to both the piston member 10 and the cylinder portions 6, 7, it is ensured that the cavity of the cylinder portions 6, 7 below the piston member 10 is reliably sealed against the outside. In addition, it has been found that this involves the lowest frictional resistance, because there is only one doubled region 15 which would not be the case, if the rolling membrane has its ends connected together as a closed loop, thus forming a toroidal body. This is the reason why such an embodiment results in the fastest possible closure times.

It is suitable to avoid the rolling membrane 9 from becoming squeezed or deformed within its gap 14. Therefore, a linear guiding device 16 can be provided in order to precisely guide any axial movement of the piston member 10 in the cylinder portions 6, 7. The guiding device can be formed, for example, by prolongations of the outer surface 11 of the piston member 10. According to a preferred embodiment, however, the linear guiding device 16 comprises a sleeve 17 and a rod member 18 guided within the sleeve. The rod member 18 can have notches along its length, and the piston member 10 can be connected to the rod member 18 within the region of a first notch 18*a*. To this end, a first ring element 19 connected to the piston member 10 can be inserted into the notch 18*a* to form a positive connection. Conveniently, a sealing ring or packing 20 can be arranged between the rod member 18 and the piston member 10.

The sleeve 17 is tightly connected to the lower cylinder portion 6 and arranged so as to align the axes of the sleeve 17 and the cylinder portion 6 to a common axis A. In the embodiment shown, a guide sleeve element 17*a* or 17*b* is arranged at both ends of the sleeve 17. However, it goes without saying that a single sleeve element of corresponding length could be used instead of the two elements 17*a* and 17*b*. FIG. 1 shows that the rod member 18, in each of its positions, will always pass the full length of the sleeve 17. In this way, it is ensured that the guiding characteristics will remain unchanged in all positions of the piston member 10. This shows that this arrangement forms a precise guiding device which does not show any tendency to jamming or clamping. In order to have a relatively long guidance of the rod member 18, the sleeve 17 can extend into and through the interior or the cavity of the cylinder portion 6. In order to enable the piston's lower front end to move close to the lower end of the cup-shaped cylinder portion 6, thus reducing the height of the assembly 5, the piston can have a central hollow structure or recess 10'.

This hollow structure 10' can be cylindrical, and so can the outer surface of the linear guide unit projecting into the cavity of the cylinder portion 6. However, by making the lower diameter of this guiding device 16 larger than the upper diameter (e.g., by tapering the outer surface of the sleeve 17 as shown), and by shaping the hollow structure 10' in a complementary way, the piston member 10 will almost be clamped to the outer surface of the sleeve 17 when it reaches the closed position (lower position) of the closure member 29 (see FIG. 1 at right), but will have more and more space when the piston 10 moves upward, thus allowing more mobility of the piston in its upper position.

The rod member 18 has a longitudinal groove 18*c*, while the sleeve has a projection or bolt 18*d* engaging and protruding into the groove 18*c*. In this way, a protection arrangement against rotation of said rod means in relation to the sleeve 17 is achieved. It is clear that such protection can be implemented in a variety of different ways. For example, the outer circumference of the rod can be flattened over its length and over a limited angular region, and a flat surface of the sleeve can be provided so that both flat surfaces engage each other. Moreover, the role of the groove 18*c* and the projection 18*d* can be inverted by making the groove in the sleeve 17 and providing a projection from the rod member 18.

In order to determine and to limit the stroke of the piston member 10 and to adjust the height or level at which the closure member 29 is mounted to the piston member 10, there is at least one stop member, which in the embodiment of FIG. 1 is a spring-ring 21 holding the bottom end of a stop bushing 22. The spring-ring 21 can be fastened onto the rod member 18, preferably in different positions. In order to prevent slipping of the spring-ring 21, there are several other notches 18*b* into which the spring-ring 21 can be inserted to vary its height or level along the rod member 18 according to the maximum stroke desired of the piston. Thus, the stop bushing 22 will abut against a resilient damping element 23 at the lower end of the sleeve 17 when the maximum stroke of the piston member 10 is reached.

It is preferable to close the lower end of the sleeve 17 tightly. To this end, a closed socket 24 is mounted at the lower end of sleeve 17, the socket having a sufficient length to accommodate the rod member 18 even in the lowest position of the piston member 10 or the closed position of the closure member 29. In order to change the maximum stroke of the piston member 10, the socket 24 can be removed to provide access to the rod member 18 and its notches 18*b*. An alternative embodiment which enables an automatic adjustment even during operation of the arrangement will be described later with reference to FIG. 2.

The upper end of the rod member 18 which protrudes from the upper end of the piston member 10 acts as a piston rod and forms part of the connection to the closure member 29. At the upper end of the rod member 18, a first plate or disk 25 is fixed which is connected to a second plate or disk 27. For connecting the two plates 25, 27, there are two parts 25', 26 which project upward from the lower plate 25, i.e. a tenon 25' which is continued over an elastic element 26 to a further tenon 25".

It has already been mentioned that the closure member houses a vibrator 28 which, in this way, is protected against the bulk material flowing over the top surface of the closure member 29. This means that the closure member 29, when opened, will be subjected to vibrations either from the flowing bulk material and/or from the oscillations of the vibrator 28. In order to keep the structure below relatively stiff in order not to affect the rolling membrane 9, it is beneficial to decouple the closure member 29 from the piston member 10 in such a way that vibrations of the closure member 29 in transverse direction to the axis A are allowed, but not transmitted to the piston member 10.

For decoupling the vibration movement of the closure member 29 from the connection to the piston member 10, two measures are provided which can be taken either separately or in combination. One measure involves providing an interconnection which allows relative displacement of the closure member 29 relative to the piston member 10. This can be effected by the two plates 25 and 27 being displaceable relative to each other in transverse direction to the longitudinal axis A of the arrangement. To this end, the tenon 25', 26, 25" engages a hole or mortise 26' which has a larger width than the width of the tenon 25' engaging it and may be a slot so that the plate can freely move relative to its engaging end 25' of the tenon 25', 26 and 25". Theoretically, the two plates could lie one onto another, but this could cause friction and wear of the two plates 25, 27. Therefore, it is preferable to insert a spacer in the form of the intermediate portion 26 of the tenon 25', 26, 25". This spacer portion is preferably elastic so as to absorb at least part of the vibrations which will occur when the closure member 29 is in open position (see FIG. 1 at left).

Another measure for decoupling the vibrational displacements of the closure member 29 with respect to the piston member 10 and the rolling membrane 9 involves making the membrane 9 relatively thin in order to reduce the internal rolling friction force acting as a resistance against the reciprocating motion of the piston member 10. Thus, the portion 26 can be provided as an elastic means for absorption of the above-mentioned vibrations and to decouple their displacement of the closure member 29 from the piston member 10. In this case, it is not necessary under all circumstances to have two plates, but to make the connection between the piston member 10 and the closure member 29 moveable with respect to each other, preferably over the elastic connection via portions 26. Of course, decoupling can be provided using a combination of both measures. In such a combination, the tenon portions 26 act both as a spacer between the two plates 25 and 27, and as an elastic connection.

As mentioned above, the second plate 27 carries preferably both the vibrator 28 and the conical closure member 29 which serves also to protect the interior of vibrator 28. Around the circumferential edge of the second plate 27, there is a seal which can possess a structure as described in the co-pending U.S. patent application Ser. No. 08/853,646. However, in the embodiment of FIG. 1, the seal is formed as an inflatable toroidal ring 30 for sealing the discharge opening 4 in a closed position of the closure member 29 (see FIG. 1 at right). As to details of the sealing arrangement, reference is made to the said U.S. Patent Application.

It is clear that the closure member 29 can have a separate cover for protecting the vibrator 28 or any other device to be protected against dust and the flowing bulk material. In order to protect also devices which are larger than the height of the closure member 29 (e.g., to protect also the piston-cylinder assembly 5) against dust and bulk material, a resilient cover 31 can be provided extending from the edge of the closure member 29 down, preferably to the cylinder portions 6, 7.

It has been mentioned that the connection between the piston-cylinder assembly 5 and the closure member 29 and/or the vibrator 28 should allow their displacement relative to each other. This can be achieved by supporting the piston-cylinder assembly so as to hold it in a mobile manner, e.g. by a Cardanic support. However, it is preferable to hold the assembly 5 in a rigid manner, and therefore it is preferable to provide at least two or more (e.g., in the present embodiment four), braces 32. These braces can be used to provide fluid supply at least to the cavity of the cylinder portions 6, 7. To this end, the braces are made hollow so that one of the braces shown in FIG. 1 (e.g. the right one), can form the supply conduit 33, whereas the other one can form the discharge conduit, although a separate discharge conduit is not necessary under all circumstances if air is used as a fluid. Thus, air supplied by the supply conduit 33 can enter the cavity of the cylinder portion 6 through a transverse bore 34. It is preferable if the vibrator 28 is a pneumatic vibrator, as is known per se, and the fluid supply over the conduit 33 of FIG. 1 is common to both devices 6 and 28. To this end, there is a connection joint bore 35 connecting the supply conduit 33 with a hose conduit 36 to the vibrator 28. The fluid discharged from the vibrator 28 flows over a discharge conduit 37, a connection joint bore 35' and through the hollow interior of the brace 32 by which it is drained from the interior of the housing portion 2. Preferably, the fluid supply conduit 33 serves also to supply air to the inflatable sealing ring 30 in a manner described in detail by the above-mentioned U.S. patent application Ser. No. 08/853,646.

In order to ensure by simple means that, in spite of the common fluid supply, the closure member 29 is lifted before the vibrator 28 is actuated, the vibrator 28 is preferably formed in such a way as to operate with a minimum pressure. As is indicated in FIG. 1, the bore 34 can be somewhat larger than the smallest portion of the bore 35 or the hose 36 (or a pressure reducing valve can be inserted into the conduit 35, 36) so that the vibrator pressure is reached only at the end of the stroke of the piston member 10, i.e. when the stop bushing 22 abuts against the counter stop 23. In this way, it is, preferably, only necessary to reduce the pressure in the supply conduit 33 to ambient at the end of a discharge cycle, thus avoiding a complicated control. Because the return movement of the closure member 29 and the piston member 10 downwards is effected passively (i.e., by gravity), and extremely quickly, the control can be made very simple, necessitating only one valve connecting alternately the fluid supply conduit 33 with a source of fluid or with the environment.

Figure 2:
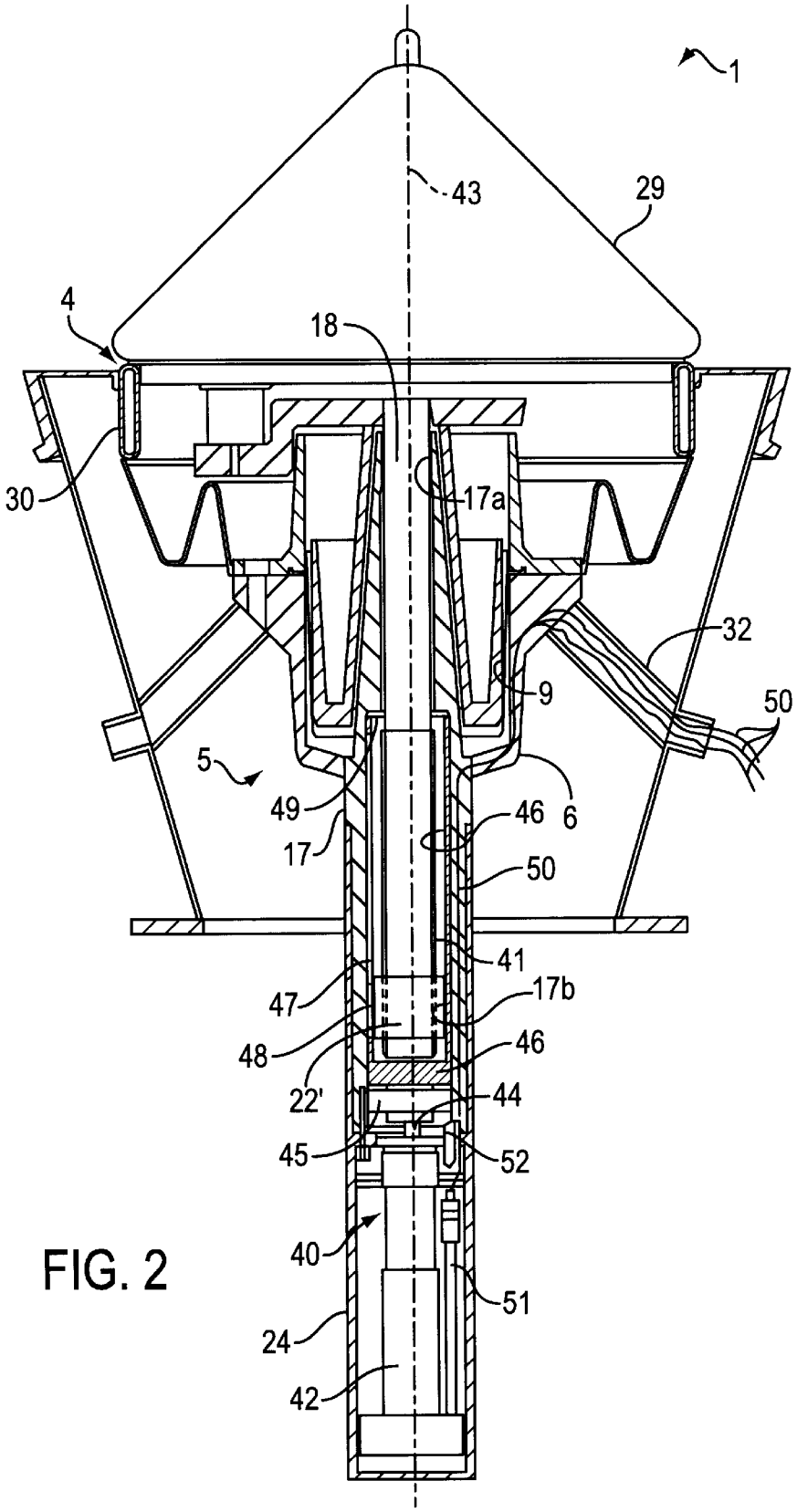
FIG. 2 shows a vertical cross-section corresponding to FIG. 1, but showing an exemplary embodiment having an automatic stroke adjustment facility.

FIG. 2 shows an alternate embodiment having an automatic stroke adjustment device 40 which enables adjustment of the height or level of the closure member 29 to be adjusted both before and while the closure member 29 is in open position. Instead of a stop bushing 22 (FIG. 1) to be positioned at different heights along the rod 18, a continuously adjustable stop bushing 22' is provided which has an inner thread engaging an outer thread 41 of the rod 18. In order to attain a displacement of the stop bushing 22' by screwing it along the rod 18, a prime mover 42 (such as a pneumatic rotating motor), is located within the socket 24 and has an axis of rotation 43 aligned with the longitudinal axis A. The housing of the motor 42 is secured either to the socket 24 and/or to the sleeve 17. The motor is adapted to be rotated in both directions and drives a short drive shaft 44. A disk-shaped body 45 is fixed to the shaft 44 on one side, whereas its other side is attached to a dog unit comprising a sleeve 46 which has a longitudinal catch slot 47 which is engaged by a radially projecting nose 48 of the stop bushing 22'. It will be understood that the arrangement could be inverse in that the sleeve 46 can have an elongated projection over the length of the slot 47 which engages a groove in the stop bushing 22'. Of course, any other dog unit will do, as will be apparent to those skilled in the art.

When the catch sleeve 46 is rotated, the nose 48, caught in the slot 47, together with the stop bushing 22' is rotated around the rod 18 too. Due to the engaging inner and outer threads, the stop bushing 22' moves along the rod 18. Since the maximum stroke of the rod 18 depends on the individual position of the bushing 22', it will be reached as soon the stop bushing attains a counter-stop 49 of the sleeve 17. Rotation of the rod 18 or torsion of the rolling membrane 9 is prevented by a protection arrangement against rotation in relation to the sleeve 17, in a manner as described above with reference to FIG. 1.

The catch sleeve 46 can be configured essentially without any play within the sleeve 17. Therefore, a linear guide surface 17*b'* is formed at the inner side of the catch sleeve 46 along which the stop bushing can slide when the rod 18 reciprocates together with the piston member 10, thus providing an exact guidance for the rod 18. This precise guidance in combination with the height adjustment device 40 for the piston-cylinder assembly 5, which comprises the rolling membrane 9, is particularly favorable and simple to realize. In comparison, wherein a flexible bellow is used according to the prior art (cf. EP-049 992-B1), problems would arise with supporting the motor 42 due to the lack of a rigid guidance.

For energizing the motor 42, three small conduits 50 are led from a valve device (not shown), through one of the hollow braces 32, the lower cylinder portion 6, the sleeve 17 and through a joint 51 to the motor 42. Two of the conduits 50 are fluid supply conduits, a respective one of which is supplied with pressurized air for adjusting the stop bushing 22' according to the direction of rotation desired of the motor 42. Each fluid supply conduit 50 is assigned to one of the two opposite directions of rotation of the motor 42. The third conduit 50 is a discharge conduit for exhaust air exiting the motor 42.

A control for alternatively supplying one or the other one of the two fluid supply conduits 50 through a suitable valve mechanism can be of any kind known per se and familiar to those skilled in the art. Such control can, for example, comprise a sensor 52 for the angular or longitudinal position. For example, the sensor 52 can be connected to the drive shaft 44 and/or the catch sleeve 46 to sense the angular position of them and to determine the longitudinal position of the stop bushing 22' from this angle information. The sensor 52 can be based on a magnetic, inductive, capacitive, optical or any desired measurement. However, as already mentioned, the position of the stop sleeve 22' itself along the rod 18 can also be sensed either instead, or in addition.

The embodiment according to FIG. 2 is particularly advantageous, because it enables precise metering. The rolling membrane 9 guarantees a quick closure motion, while the automatic height adjustment ensures an adjustable cross-section of flow. Therefore, if closing the discharge opening is commanded in a precisely determined moment, the quantity discharged corresponds to the quantity desired. Metering is exactly reproducible by a precise adjustment facility of the desired stroke and opening and by control of the desired period of opening the closure member 29. In order to discharge a large quantity, the stroke of the piston member 10 can be adjusted during discharging so that there is a large stream of bulk material initially and a small flow at the end in order to be able to meter the last portion of the bulk material precisely.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A discharge arrangement for discharging bulk material from a receptacle, comprising:

wall means forming a housing of said receptacle, said housing having a discharge opening;

closure means movable from an open position into a closed position for closing said discharge opening;

actuator means connected to said closure means for moving said closure means into one of said open and closed positions, said actuator means including:

a cylinder extending along a longitudinal axis and having a first predetermined inner surface diameter defining a cavity, a first front end, and an opposing second front end;

a piston movable relative to said cylinder along said longitudinal axis and having a second predetermined outer surface diameter smaller than said first diameter to leave a gap between the inner surface of said cylinder and the outer surface of said piston, said piston further having a first front side and an opposing second front side;

a rolling membrane member between said inner surface of said cylinder and said outer surface of said piston to seal said gap and provide rolling friction when said piston moves within said cylinder;

fluid supply means connected to said cavity for moving said piston;

connecting means for interconnecting said first front side of said piston and said closure means; and linear guide means between said cylinder and said piston for guiding movement of said piston, said linear guide means being attached to said piston at its second front side.

2. Discharge arrangement as claimed in claim 1, wherein said linear guide means comprise:

sleeve means having a first front end and an opposing second front end, said first front end being tightly connected to said second front end of said cylinder, while said second front end of said sleeve means is closed; and rod means connected to said piston and extending into said sleeve means.

3. Discharge arrangement as claimed in claim 2, wherein said sleeve means comprise:

a narrow portion for guiding said rod means and a wider portion, said narrow and wider portions being arranged successively along said longitudinal axis.

4. Discharge arrangement as claimed in claim 2, wherein said narrow and said wider portions are formed by two separate parts fastened together.

5. Discharge arrangement as claimed in claim 2, wherein said linear guide means further comprise:

a protection arrangement against rotation of said rod means, said protection arrangement being situated between said sleeve means and said rod means.

6. Discharge arrangement as claimed in claim 5, wherein said protection arrangement comprises:

groove means extending parallel to said longitudinal axis and a projecting part engaging said groove means, one of said groove means and said projecting part being located on said rod means, and the other being located on said sleeve means.

7. Discharge arrangement as claimed in claim 1, further comprising:

height adjusting means connected to said piston for adjusting the level of said closure means relative to said discharge opening.

8. Discharge arrangement as claimed in claim 7, wherein said linear guide means comprise:

sleeve means having a first front end and an opposing second front end, said first front end being tightly connected to said second front end of said cylinder, while said second front end of said sleeve means is closed; and rod means connected to said piston and extending into said sleeve means, said height adjusting means comprising stop means positioned along said rod means in different positions for limiting the stroke of said piston.

9. Discharge arrangement as claimed in claim 8, further comprising:

prime mover means for positioning said stop means along said rod means.

10. Discharge arrangement as claimed in claim 9, wherein said prime mover means comprise:

a rotatable pneumatic motor.

11. Discharge arrangement as claimed in claim 8, wherein said stop means comprise:

bushing means having an inner thread, whereas said rod means have an outer thread, said inner and outer threads engaging each other.

12. Discharge arrangement as claimed in claim 9, wherein said prime mover means comprise:

a rotatable motor, the arrangement further comprising dog means rotatable by said motor, and bushing means including engagement means for engaging said dog means to move said dog means along said rod means when said dog means are rotated.

13. Discharge arrangement as claimed in claim 1, further comprising:

vibrating means connected to said closure means.

14. Discharge arrangement as claimed in claim 1, wherein said linear guide means comprise:

an elongated guide member extending along said longitudinal axis and being connected to said cylinder, said guide member having a top end and a bottom end, said top end having a smaller width than said bottom end, said piston having a hollow structure configured complementary in dimension to said guide member so that said hollow structure substantially engages said guide member when said closure means are in said closed position, and forms an annular gap between said hollow structure and said guide member when said closure means are in said open position.

15. Discharge arrangement as claimed in claim 14, wherein said guide member is is substantially conical, said hollow structure forming a hollow cone.

16. A discharge arrangement for discharging bulk material from a receptacle, comprising:

wall means forming a housing of said receptacle, said housing having a discharge opening;

closure means movable from an open position into a closed position for closing said discharge opening;

actuator means connected to said closure means for moving said closure means into one of said open and closed positions, said actuator means including:

a cylinder extending along a longitudinal axis and having a first predetermined inner surface diameter defining a cavity, a first front end and an opposing second front end, said first front end being open;

a piston movable relative to said cylinder along said longitudinal axis and having a second predetermined outer surface diameter smaller than said first diameter to leave a gap between the inner surface of said cylinder and the outer surface of said piston, said piston further having a first front side facing said first front end and an opposing second front side facing said second front end of said cylinder;

a rolling membrane member between said inner surface of said cylinder and said outer surface of said piston to seal said gap and provide rolling friction when said piston moves within said cylinder;

fluid supply means connected to said cavity for moving said piston;

connecting means for interconnecting said first front side of said piston and said closure means; and linear guide means between said cylinder and said piston for guiding the movement of said piston.

17. Discharge arrangement as claimed in claim 16, wherein said rolling membrane member is connected at least to one of said cylinder and piston to secure its relative position.

18. Discharge arrangement as claimed in claim 17, wherein said rolling membrane member is connected to both said cylinder and said piston.

19. Discharge arrangement as claimed in claim 16, wherein said cylinder comprises:

a cup-shaped portion and a sleeve-shaped portion fastened together.

20. Discharge arrangement as claimed in claim 16, further comprising:

sealing means extending around a second plate means for engaging said wall means in the region of said discharge opening when said closure means are in said closed position.

21. Discharge arrangement as claimed in claim 20, wherein said sealing means are hollow and are expandable under fluid pressure.

22. Discharge arrangement as claimed in claim 16, further comprising:

resilient covering means connected to said closure means and surrounding said cylinder at least in part.

23. A discharge arrangement for discharging bulk material from a receptacle, comprising:

wall means forming a housing of said receptacle, said housing having a discharge opening;

closure means movable from an open position into a closed position for closing said discharge opening;

actuator means connected to said closure means for moving said closure means into one of said open and closed positions, said actuator means including:

a cylinder extending along a longitudinal axis and having a first predetermined inner surface diameter defining a cavity, a first front end and an opposing second front end;

a piston movable relative to said cylinder along said longitudinal axis and having a second predetermined outer surface diameter smaller than said first diameter to leave a gap between the inner surface of said cylinder and the outer surface of said piston, said piston further having a first front side and an opposing second front side;

a rolling membrane member between said inner surface of said cylinder and said outer surface of said piston to seal said gap and provide rolling friction when said piston moves within said cylinder;

fluid supply means connected to said cavity for moving said piston;

connecting means for interconnecting said first front side of said piston and said closure means, said connecting means including transverse motion decoupling means to decouple substantially any movement of said closure means in a direction transverse to said longitudinal axis from said piston and rolling membrane means; and linear guide means between said cylinder and said piston for guiding the movement of said piston.

24. Discharge arrangement as claimed in claim 23, wherein said decoupling means comprise:

first plate means connected to said piston and second plate means connected to said closure means, said first and second plate means being displaceably interconnected relative to each other.

25. Discharge arrangement as claimed in claim 23, further comprising:

elastic connection means interconnecting said first and second plate means.

26. Discharge arrangement as claimed in claim 24, wherein said first and second plate means are interconnected by a mortise-and tenon connection having a mortise larger than a tenon to enable relative displacement.

27. Discharge arrangement as claimed in claim 24, further comprising:

spacer means between said first and second plate means.

28. Discharge arrangement as claimed in claim 27, wherein said spacer means are elastic.

29. Discharge arrangement as claimed in claim 23, further comprising:

vibrating means connected to said closure means.

30. Discharge arrangement as claimed in claim 29, wherein said vibrating means are fluid operated and said fluid supply means are common to said cylinder and said vibrating means.

31. A discharge arrangement for discharging bulk material from a receptacle, comprising:

wall means forming a housing of said receptacle, said housing having a discharge opening;

closure means movable from an open position into a closed position for closing said discharge opening;

actuator means connected to said closure means for moving said closure means into one of said open and closed positions, said actuator means including:

a cylinder extending along a longitudinal axis and having a first predetermined inner surface diameter defining a cavity, a first front end and an opposing second front end, said first front end being open, said cylinder being composed of a cup-shaped portion and a sleeve-shaped portion fastened together;

a piston movable relative to said cylinder along said longitudinal axis and having a second predetermined outer surface diameter smaller than said first diameter to leave a gap between the inner surface of said cylinder and the outer surface of said piston, said piston further having a first front side facing said first front end and an opposing second front side facing said second front end of said cylinder;

a rolling membrane member between said inner surface of said cylinder and said outer surface of said piston to seal said gap and provide rolling friction when said piston moves within said cylinder, said rolling membrane being connected to both said cylinder and said piston;

fluid supply means connected to said cavity for moving said piston;

connecting means for interconnecting said first front side of said piston and said closure means; and linear guide means between said cylinder and said piston for guiding movement of said piston.

32. Discharge arrangement as claimed in claim 31, wherein said rolling membrane member comprises:

a first and a second end, said first end being connected to said cylinder, while said second end is connected to said piston, the rolling membrane member forming an annular reversing portion between said first and second ends where said rolling membrane member is doubled, said reversing portion rolling over part of a length of said rolling membrane member between said first and second ends when said piston moves within said cylinder.

33. Discharge arrangement as claimed in claim 31, wherein said first end of said rolling membrane member is fastened between said cup-shaped portion and said sleeve-shaped portion of said cylinder.

* * * * *